United States Patent [19]

Shiba et al.

[11] 3,945,832

[45] Mar. 23, 1976

[54] FOGGED, DIRECT-POSITIVE SILVER HALIDE EMULSION CONTAINING DESENSITIZERS AND A DIMETHINE OPTICAL SENSITIZING DYE

[75] Inventors: Keisuke Shiba; Masanao Hinata; Reiichi Ohi; Tadao Shishido, all of Kanagawa, Japan

[73] Assignee: Fuji Photo Film Co., Ltd., Minami-ashigara, Japan

[22] Filed: Mar. 27, 1974

[21] Appl. No.: 455,095

[30] Foreign Application Priority Data

Mar. 27, 1973 Japan ..... 48-35376

[52] U.S. Cl. ..... 96/100; 96/107; 96/108; 96/101; 96/129; 96/130; 260/240 E.

[51] Int. Cl.[2] ... G03C 1/36; G03C 1/28; G03C 1/02

[58] Field of Search ..... 96/101, 130, 107–108, 96/100, 129; 260/240 E

[56] References Cited

UNITED STATES PATENTS

| | | | |
|---|---|---|---|
| 2,669,515 | 2/1954 | Kendall et al. | 96/101 |
| 3,035,917 | 5/1962 | Fry et al. | 96/101 |
| 3,124,458 | 3/1964 | Fry et al. | 96/101 |
| 3,367;778 | 2/1968 | Berriman | 96/108 |
| 3,628,958 | 3/1970 | Haefner | 96/101 |
| 3,816,138 | 6/1974 | Ohlschlager | 96/101 |
| 3,832,184 | 8/1974 | Sato et al. | 96/101 |

*Primary Examiner*—Won H. Louie, Jr.
*Attorney, Agent, or Firm*—Sughrue, Rothwell, Mion, Zinn & Macpeak

[57] ABSTRACT

A direct positive silver halide photographic emulsion containing 1. at least one dimethine dye having the general formula (I):

(I)

2. at least one compound having the general formula (II):

(II)

3. at least one compound having the general formula (III)

(III)

or the general formula (IV)

(IV)

wherein Y, $Y_o$, Z, $L_1$, $L_2$, $R_o$, *m*, *n*, X, $Z_1$, $R_1$, $X_1$, *a*, *p*, *q*, $Y_1$, $Y_2$, $m_1$, $R_3$, *r*, $X_2$ and $X_3$ are as hereinafter defined.

14 Claims, No Drawings

FOGGED, DIRECT-POSITIVE SILVER HALIDE EMULSION CONTAINING DESENSITIZERS AND A DIMETHINE OPTICAL SENSITIZING DYE

BACKGROUND OF THE INVENTION

1. Field of the Invention

This invention relates to direct positive silver halide photographic emulsions and, in particular, to an improvement in such emulsions spectrally sensitized with dimethine dyes.

2. Description of the Prior Art

When a silver halide photosensitive material is developed after exposure to light to which the material is spectrally sensitive, the emulsion layer blackens whereby the optical density increases with the increase in the amount of exposure, reaching a maximum. When the exposure amount surpasses the value corresponding to this maximum density, the density then decreases, thus finally giving a positive image from a negative. Such a phenomenon is generally referred to as solarization.

A similar phenomenon of density reversal is also observed with silver halides which have been either optically or chemically fogged during the manufacturing process of the emulsions. The term, "direct positive silver halide photographic emulsion" as used in the present specification means an emulsion which gives an optically positive image upon an ordinary image exposure to light followed by an usual development.

Many dyes are known which can be advantageously used for the spectral sensitization of usual negative silver halide emulsions. However, all of these dyes are not suited for the sensitization of direct positive emulsions. Use of these dyes in direct positive silver halide emulsions is sometimes accompanied by various disadvantages including a softening of the characteristic curve, or re-reversal phenomenon which refers to a density increase after the decrease of density in the solarization region. Moreover, the addition of such dyes to direct positive silver halide emulsions reduces the maximum density exhibited by the original emulsions.

Many dyes useful for spectral sensitization of direct positive silver halide emulsions are already known in the art. Patent specifications such as U.S. Pat. Nos. 3,314,796; 3,586,672; 3,314,796 and 3,598,596, and U.S. patent application Ser. No. 318,047, filed Dec. 26, 1972 have disclosed special usefulness of dimethine dyes containing indole nuclei.

It is also known from U.S. Pat. Nos. 3,592,653 and 3,598,603 that dimethine dyes containing pyrole nuclei are particularly useful for spectral sensitization of direct positive silver halide emulsions.

Further, the present inventors have already discovered that dimethine dyes having pyrazolo (1,5 - a) benzimidazole nuclei are particularly useful for the sensitization of direct positive silver halide emulsions as disclosed U.S. patent application Ser. No. 351,386, filed Apr. 16, 1973.

The inventors have also disclosed the usefulness of dimethine dyes having pyrazolo (5,1 - b) quinazolone nuclei for the sensitization of direct positive silver halide emulsions in U.S. patent application Ser. No. 379,887, filed Sept. 16, 1973.

On the other hand, U.S. Pat. No. 3,615,610 describes that the combined use of the above-described dimethine dyes and nitrostyryl dyes in direct positive silver halide emulsions results in an increased photographic speed, a reduced minimum density and an improvement in stability during storage.

Further, U.S. Pat. No 3,583,870 discloses that the combined use of sensitizing dyes excellent for the sensitization of negative silver halide emulsions and dipyridinium salt compounds in direct positive emulsions brings about an increase of spectral sensitivity as well as a reduction of the minimum density.

However, the most serious problem in the technology of direct positive silver halide photographic emulsions is the insufficient sensitivity for various photographic applications. Therefore, a sensitivity increase of direct positive silver halide emulsions, particularly by dye sensitization, is quite urgently desired.

An object of the present invention is to provide contrasty direct positive silver halide photographic emulsions which retain the maximum densities of the original emulsions and which exhibit high sensitivities as well as very low minimum densities.

SUMMARY OF THE INVENTION

The above described object has been achieved by incorporating into direct positive silver halide emulsions at least one of the dimethine dyes represented by the following general formula (I):

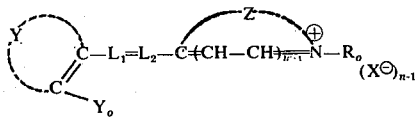

(I)

wherein Y represents the non-metallic atoms necessary to complete a heterocyclic nucleus; $Y_o$ represents a hydrogen atom, an alkyl group, an aryl group, a carboxyl group, a halogen atom, an alkoxy group, an alkoxycarbonyl group, or a hydroxyl group, and further $Y_o$ may form a heterocyclic ring together with Y; Z represents the non-metallic atoms necessary to complete a 5- or 6-membered heterocyclic ring; $L_1$ and $L_2$ each represents a methine group; $R_4$ represents a substituted or unsubstituted alkyl group or an aryl group; m and n each represent an integer of 1 or 2; $R_o$ represents a substituted or unsubstituted alkyl group or an aryl group; and X represents an anion; at least one compound represented by the general formula (II):

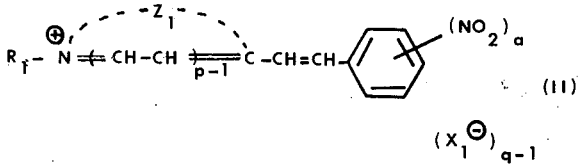

(II)

wherein $Z_1$ and $X_1$ represents the same groups as Z and X, respectively; $R_1$ represents a substituted or unsubstituted alkyl group; and *a*, *p* and *q* each represents an integer of 1 or 2; and additionally at least one compound represented by the general formula (III)

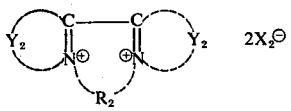

(III)

wherein $Y_1$ and $Y_2$, which can be the same or different each represents the non-metallic atoms necessary to form a pyridine, benzothiazole or benzimidazole ring, and $Y_1$ and $Y_2$ can be combined to form a 1,10-phenanthroline ring; $R_2$ represents $-(CH_2)_{m_1}$, wherein $m_1$ represents an integer of from 2 to 4, —CH=CH—, or

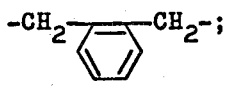

and $X_2$ rpresents an anion; or the general formula (IV)

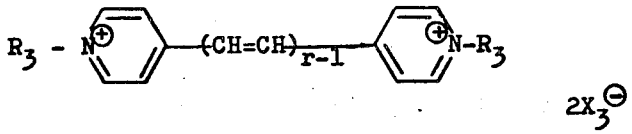

(IV)

wherein $R_3$ has the same meaning as $R_1$; $X_3$ represents an anion; and $r$ represents 1 or 2.

DETAILED DESCRIPTION OF THE INVENTION

As described above in the general formula (I), Z represents the non-metallic atoms necessary to complete a 5- or 6-membered heterocyclic ring which can be present in cyanine dyes which act as sensitizers or desensitizers. Typical heterocyclic nyclei formed by Z include, for example, a thiazole nucleus (e.g., thiazole, 4-methylthiazole, 4-phenylthiazole, 4,5-dimethylthiazole, 4,5-diphenylthiazole, etc.), a benzothiazole nucleus (e.g., benzothiazole, 5-nitrobenzothiazole, 5-chlorobenzothiazole, 5-methylbenzothiazole, 5-bromobenzothiazole, 5-iodobenzothiazole, 5-phenylbenzothiazole, 5-methoxybenzothiazole, 5-methoxycarbonylbenzothiazole, 5-carboxybenzothiazole, 6-nitrobenzothiazole, 6-chlorobenzothiazole, 6-methylbenzothiazole, 6-bromobenzothiazole, 6-iodobenzothiazole, 6-phenylbenzothiazole, 6-methoxybenzothiazole, tetrahydrobenzothiazole, 5,6-dioxymethylenebenzothiazole, 5,6-dimethylbenzothiazole, 5-hydroxybenzothiazole, etc.), a naphtho-thiazole nucleus (e.g., α-naphthothiazole, β-naphthothiazole, β,β-naphthothiazole, etc.), an oxazole nucleus (e.g., oxazole, 4-methyloxazole, 4-phenyloxazole, 4,5-diphenyloxazole, etc.), a benzoxazole nucleus (e.g., benzoxazole, 5-chlorobenzoxazole, 5-methylbenzoxazole, 5-nitrobenzoxazole, 5-methoxybenzoxazole, 5,6-dimethylbenzoxazole, etc.), a naphthoxazole nucleus (e.g., α-naphthoxazole, β-naphthoxazole, β,β-naphthoxazole, etc.), an indolenine nuclues (e.g., 3,3-dimethyl-5-nitroindolenine, etc.), a benzoselenazole nucleus (e.g., benzoselenazole, 5-chlorobenzoselenazole, 5-nitrobenzoselenazole, 5-methylbenzoselenazole, 5-methoxybenzoselenazole, 6-nitrobenzoselenazole, etc.), a naphthoselenazole nucleus (α-naphthoselenazole, β-naphthoselenazole, etc.), a quinoline nucleus (e.g., 2-quinoline, 3-methyl-4-quinoline, 6-chloro-2-quinoline, 6-nitro-2-quinoline, 6-methoxy-2-quinoline, 8-chloro-2-quinoline, 4-quinoline, 6 -methoxy-4-quinoline, 6-nitro-4-quinoline, 8-chloro-4-quinoline, etc.), a thiazoline nucleus (e.g., thiazoline, 4-methylthiazoline, etc.), a pyridine nucleus (e.g., 2-pyridine, 4-pyridine, nitro-substituted pyridines, etc.), an imidazole nucleus (e.g., 1-methylimidazole, 1-methyl-4-phenylimidazole, etc.), a benzimidazole nucleus (e.g., 1-methylbenzimidazole, 1-ethyl-5-chlorobenzimidazole, 1-ethyl-5,6-dichlorobenzimidazole, 1-ethyl-5-methoxycarbonylbenzimidazole, 1-ethyl-5-nitrobenzimidazole, 1-ethyl-5-chloro-6-nitro-benzimidazole), imidazo[4,5-b]quinoxaline (e.g., 1,3-diethylimidazo[4,5-b]-quinoxaline, 1,3-diallylimidazo[4,5-b]quinoxaline, 1,3-diphenylimidazo[4,5-b]quinoxaline, etc.).

Suitable examples of heterocyclic rings for Y are an indole nucleus, a pyrrole nucleus, a pyrazole[5,1-b]quinazolone nucleus, a pyrazolo[1,5-a]benzimidazolo nucleus, etc.

$Y_o$ represents a hydrogen atom, an alkyl group (e.g., having 8 or less carbon atoms), an aryl group (e.g., having 10 or less carbon atoms), a carboxyl group, a halogen atom, an alkoxy group (e.g., having 5 or less carbon atoms), an alkoxycarbonyl group (e.g., having 6 or less carbon atoms) or a hydroxl group or further may combine with Y to form a heterocyclic ring.

$L_1$ and $L_2$ each represents a methine radical such as —CH=, —$CR_4$=, etc. $R_4$ represents preferably an alkyl group such as a methyl or ethyl group, an aryl group such as a phenyl group, or a substituted alkyl group such as an ethoxyethyl group. X represents an anion such as, for example, a chloride, bromide, iodide, thiocyanate perchlorate, p-toluenesulfonate, methyl sulfate, ethyl sulfate, etc., ion.

$R_o$ represents an alkyl group (e.g., having 8 or less carbon atoms) such as methyl, ethyl, propyl, iso-propyl, n-butyl, hexyl, a hydroxyalkyl group (e.g., having 4 or less carbon atoms such as β-hydroxyethyl, γ-hydroxypropyl), an acetoxyalkyl group (e.g., having 8 or less carbon atoms such as β-acetoxyethyl, γ-acetoxypropyl, etc.), a carboxyalkyl group (e.g., having 8 or les carbon atoms such as β-carboxyethyl, γ-carboxypropyl, δ-carboxybutyl, ω-carboxybenzyl, etc.), an alkoxycarbonylalkyl group (e.g., having 8 or less carbon atoms such as β-methoxycarbonylethyl, γ-ethoxycarbonylpropyl, etc.), a sulfoalkyl group (e.g., having 5 or less carbon atoms such as β-sulfoethyl, γ-sulfopropyl, γ-sulfobutyl, δ-sulfobutyl, etc.), an aralkyl group (e.g., having 10 or less carbon atoms such as benzyl, phenethyl, p-sulfophenethyl, p-carboxyphenethyl, etc.), a vinylmethyl group, an aryl group (e.g., phenyl), etc.

In the general formula (II) and in the general formula (IV) $R_1$ and $R_3$, respectively, each represents an alkyl group (e.g., having 8 or less carbon atoms) including an unsubstituted alkyl group, such as methyl, ethyl, propyl, isopropyl, n-butyl, and a substituted alkyl group such as a hydroxyalkyl group, β-hydroxyethyl, γ-hydroxypropyl, etc., an acyloxyalkyl such as β-acetoxyethyl, γ-acetoxypropyl, etc., a carboxyalkyl group such as β-carboxyethyl, γ-carboxypropyl, δ-carboxybutyl, ω-carboxypentyl, etc., an alkoxyalkyl group such as β-methoxycarbonylethyl, γ-ethoxycarbonylpropyl, etc., a sulfoalkyl group such as β-sulfoethyl, γ-sulfopropyl, γ-sulfobutyl, δ-sulfobutyl, etc., an unsubstituted aralkyl group such as benzyl and phenethyl, a sulfoaralkyl group such as p-sulfophenethyl, a carboxyaralkyl group as p-carboxyphenethyl, or a vinylmethyl group.

In the general formula III, $Y_1$ and $Y_2$, which can be the same as or different from each other, each represents the nonmetallic atoms necessary to complete any of a pyridine, a benzothiazole, and a benzimidazole, ring. In addition, $Y_1$ and $Y_2$ can be combined together to form a 1,1-phenanthroline ring.

Among the dimethine dyes represented by the general formula (I), particularly preferred examples are further described in the following.

The dyes represented by the following general formula (V) are especially useful of those containing an indole nucleus as the heterocyclic ring completed by Y in the general formula (I).

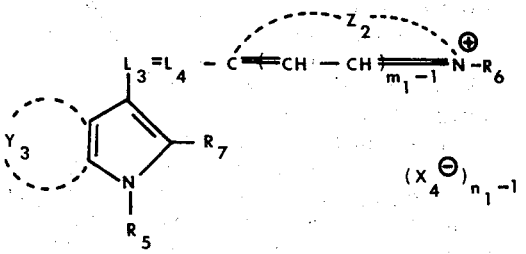

(V)

In the formula (V), $R_7$ represents a hydrogen atom; a lower alkyl group (e.g., having 1 to 8 carbon atoms) such as methyl or ethyl; a halogen atom such as chlorine; a carboxyl group; a lower alkoxycarbonyl group (e.g., having 2 to 5 carbon atoms) such as methoxycarbonyl, ethoxycarbonyl or t-butoxycarbonyl, etc.; an aryl group such as phenyl or phenyl groups substituted with alkyl or alkoxy groups or halogen atoms.

$Y_3$ represents the non-metallic atoms necessary to complete a condensed benzene ring, which can be substituted with substituents such as halogen atoms, or alkyl or alkoxy groups.

$Z_2$, $L_3$ and $L_4$ each have the same significance as Z, $L_1$ and $L_2$, respectively.

$R_5$ represents a hydrogen atom, an alkyl group (e.g., having 1 to 6 carbon atoms) such as methyl, ethyl, propyl, isopropyl, n-butyl, or hexyl, a hydroxyalkyl group such as β-hydroxyethyl, or γ-hydroxypropyl, an acetoxyalkyl group such as β-acetoxyethyl or γ-acetoxypropyl, a carboxyalkyl group such as β-carboxyethyl, γ-carboxypropyl, δ-carboxybutyl or ω-carboxypentyl, an alkoxycarbonylalkyl group such as β-methoxycarbonylethyl or γ-ethoxycarbonylpropyl, a sulfoalkyl group such as β-sulfoethyl, γ-sulfopropyl, γ-sulfobutyl, or δ-sulfobutyl, an aralkyl group such as benzyl, phenethyl, p-sulfophenethyl or p-carboxyphenethyl, a vinylmethyl group or an aryl group such as phenyl.

$R_6$, $m_1$, $n_1$ and $X_4$ each have the same meaning as $R_0$, $m$, $n$ and X, respectively.

The dyes described above can be synthesized using the methods described in U.S. Pat. No. 3,314,796 and also in U.S. patent application Ser. No. 318,047, filed Dec. 26, 1972.

Among the dyes in which the heterocyclic ring completed by Y in the general formula (I) is a pyrrole nucleus, those which are particularly useful can be represented by the following general formula (VI).

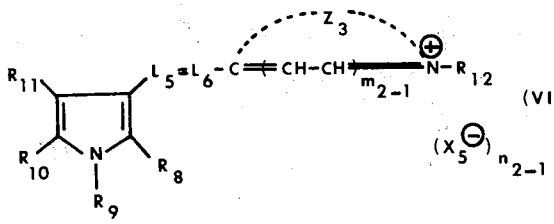

(VI)

In the formula, $R_8$ represents an alkyl group (e.g., having 1 to 12 carbon atoms, peferably a lower alkyl group having 1 to 4 carbon atoms) such as methyl, ethyl, propyl, butyl, cyclohexyl or phenethyl, or an aryl group such as phenyl, chlorophenyl, tolyl, methoxyphenyl, naphthyl or nitrophenyl.

$R_{10}$ represents a hydrogen atom, an alkyl group (e.g., having 1 to 12 carbon atoms) such as methyl, ethyl, propyl, isopropyl, butyl, cyclohexyl, decyl, or phenethyl or an aryl group such as phenyl, tolyl, chlorophenyl, nitrophenyl, methoxyphenyl, etc.

$R_{11}$ represents a hydrogen atom, an alkyl group (e.g., having 1 to 12 carbon atoms) such as methyl, ethyl, propyl, butyl, cyclohexyl, or phenethyl, a carboxyl group, or an alkoxycarbonyl group (e.g., having 2 to 8 carbon atoms) such as methoxycarbonyl, ethoxycarbonyl, t-butoxycarbonyl or benzyloxycarbonyl.

$R_9$ and $R_{12}$ each has the same meaning as $R_o$ and $Z_3$ has the same meaning as Z.

$m_2$, $n_2$, $X_5$, $L_5$ and $L_6$, each have the same meaning as $m$, $n$, X, $L_1$ and $L_2$, respectively.

The above-described dyes can be prepared using the synthetic methods disclosed in U.S. Pat. Nos. 3,592,653 and 3,598,603.

Among the dyes which include a pyrazolo[5,1-b]quinazolone nucleus as the heterocyclic ring completed by Y in the general formula (I), those represented by any of the following general formulae (VII) and (VIII) are particularly useful.

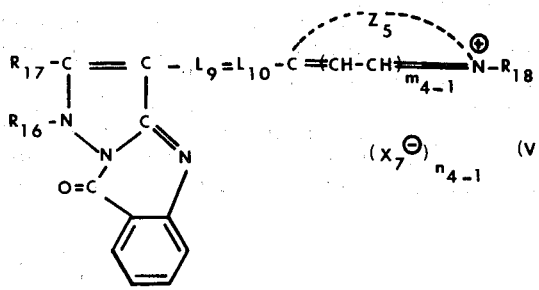

(VII)

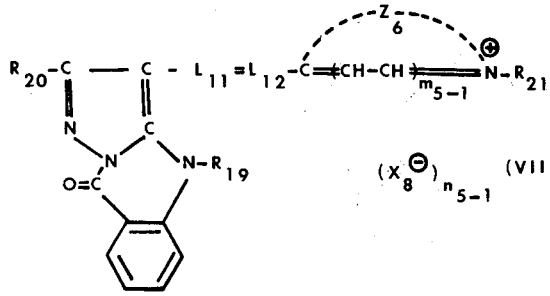

(VIII)

In the formulae, $R_{17}$ and $R_{20}$ each represents the substitutents known in pyrazole[5,1-b]quinazolone compounds.

For example, each represents a hydrogen atom, an alkyl group (e.g., having 1 to 8 carbon atoms) such as methyl, ethyl, propyl or benzyl, an aryl group such as phenyl, p-methoxyphenyl, etc., a carboxyl group, an alkoxycarbonyl group (e.g., having 2 to 9 carbon atoms) such as methoxycarbonyl, ethoxycarbonyl, etc., an alkoxy group (e.g., having 1 to 8 carbon atoms) such as methoxy, ethoxy, etc., or a hydroxyl group.

$R_{16}$ represents an alkyl group, including unsubstituted alkyl groups (e.g., having 8 or less carbon atoms) such as methyl, ethyl, propyl, isopropyl, n-butyl, n-pentyl, n-hexyl, etc., hydroxyalkyl groups (e.g., having 5 or less carbon atoms) such as β-hydroxyethyl, γ-hydroxypropyl, etc., alkoxyalkyl groups (e.g., having 8 or less carbon atoms) such as β-methoxyethyl, γ-methoxypropyl, etc., carboxyalkyl group (e.g., having 8 or less carbon atoms) such as β-carboxyethyl, γ-carboxypropyl, δ-carboxybutyl, ω-carboxypentyl, etc., alkoxycarbonylalkyl groups (e.g., having 8 or less carbon atoms) such as γ-ethoxycarbonylpropyl, β-methoxycarbonylethyl, etc., sulfoalkyl groups (e.g., having 5 or less carbon atoms) such as β-sulfoethyl, γ-sulfopropyl, γ-sulfobutyl, δ-sulfobutyl, etc., aralkyl groups (e.g., having 7 to 10 carbon atoms) such as benzyl, phenethyl, etc., sulfoaralkyl groups (e.g., having 7 to 10 carbon atoms) such as p-sulfophenethyl, etc., carboxyaralkyl groups (e.g., having 8 to 11 carbon atoms) such as p-carboxyphenethyl, etc., and vinylmethyl groups.

$R_{18}$ and $R_{21}$ each has the same meaning as $R_o$, $L_9$ and $L_{10}$ as well as $L_{11}$ and $L_{12}$ each has the same meaning as $L_1$ and $L_2$, respectively. 1 to 8 carbon atoms) such as methyl, ethyl, propyl, etc., a cycloalkyl group (e.g., having 3 to 8 carbon atoms) such as cyclohexyl, etc., or an aryl group such as phenyl, etc.

$Z_5$ and $Z_6$ each has the same meaning as Z.

$m_4$ and $m_5$ each has the same meaning as $m$, $n_4$ and $n_5$ each has the same meaning as $n$, and $X_7$ and $X_8$ each have the same meaning as X.

The above-described dyes can be prepared using the synthetic methods disclosed in U.S. patent application Ser. No. 379,887, filed Sept. 16, 1973.

Among the dyes including a pyrazole[1,5-a]benzimidazole nucleus as the heterocyclic ring completed by Y in the general formula (I), particularly useful dyes are expressed by the following general formula (IX).

In the formula, $R_{13}$ represents an alkyl group (e.g., having 1 to 6 carbon atoms) including an unsubstituted alkyl group such as methyl, ethyl, propyl, isopropyl, n-butyl, n-pentyl, n-hexyl, etc., and a substituted alkyl group, a hydroxyalkyl group such as β-hydroxyethyl, γ-hydroxypropyl, etc., an acetoxyalkyl group (e.g., having 1 to 6 carbon atoms) such as β-acetoxyethyl, γ-acetoxypropyl, etc., an alkoxyalkyl group (e.g., having 2 to 6 carbon atoms) such as β-methoxyethyl, γ-methoxypropyl, etc., a carboxyalkyl group (e.g., having 2 to 6 carbon atoms) such as β-carboxyethyl, γ-carboxypropyl, δ-carboxybutyl, ω-carboxypentyl, etc., an alkoxycarbonylalkyl group (e.g., having 3 to 6 carbon atoms) such as β-methoxycarbonylethyl, γ-ethoxycarbonylpropyl, etc., a sulfoalkyl group such as β-sulfoethyl, γ-sulfopropyl, γ-sulfobutyl, δ-sulfobutyl, etc., an aralkyl group such as benzyl, phenethyl, etc., a carboxyaralkyl group such as p-carboxyphenethyl, etc., a vinylmethyl group, etc.

$R_{14}$ represents the substituents known in pyrazolo[1,5-a]-benzimidazole compounds, including a hydrogen atom, an alkyl group (e.g., having 8 or less carbon atoms) such as methyl, ethyl, propyl, benzyl, etc., a carboxyl group, an alkoxycarbonyl group (e.g., having 8 or less carbon atoms) such as methoxycarbonyl, ethoxycarbonyl, etc., an aryl group such as phenyl, etc. $R_{15}$ has the same meaning as $R_o$, $Z_4$ as Z, $m_3$ as $m$, $n_3$ as $n$, and $X_6$ as X, respectively.

The above-described dyes can be synthesized using the methods disclosed in U.S. patent application Ser. No. 351,386, filed Apr. 16, 1973.

Some specific examples of the dimethine dyes represented by the general formula (I) are be given hereinafter.

It should be noted that the compounds suitable for the present invention are not limited to the following compounds.

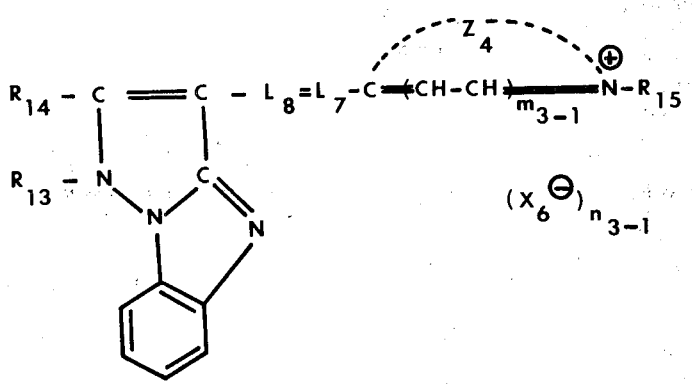

(IX)

(I - 1)

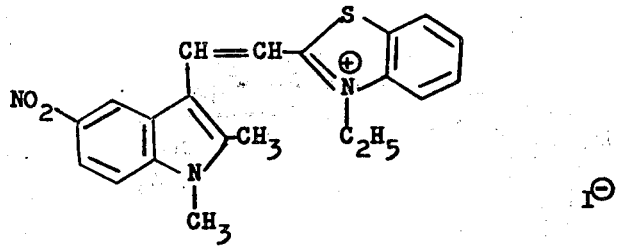

(I - 2)
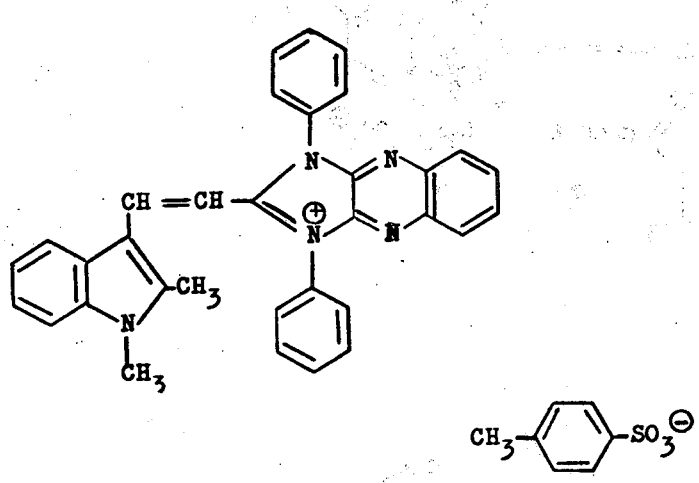
(I - 3)
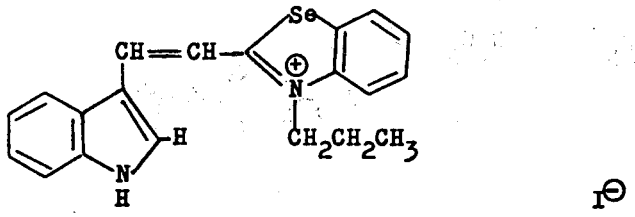
(I - 4)
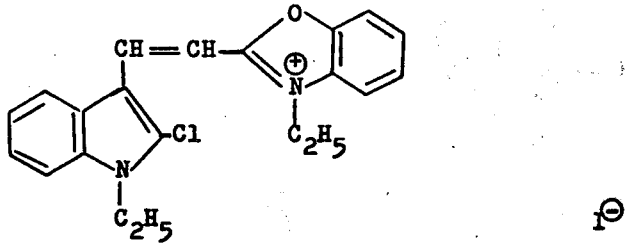
(I - 5)
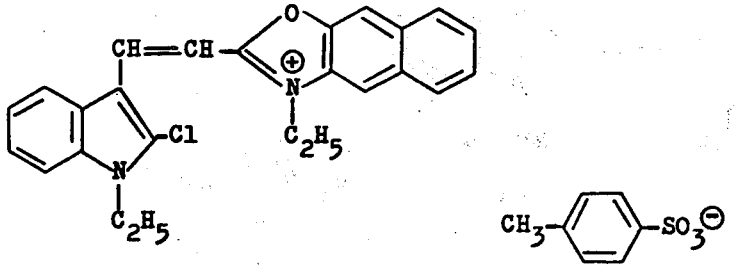

(I - 6)
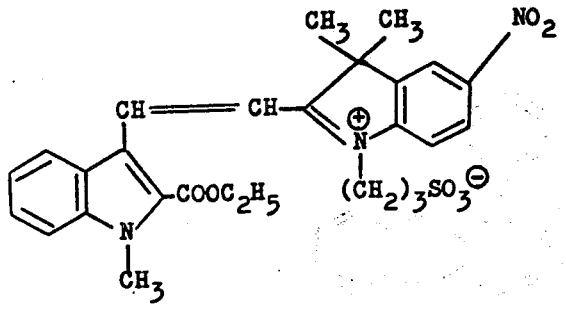
(I - 7)
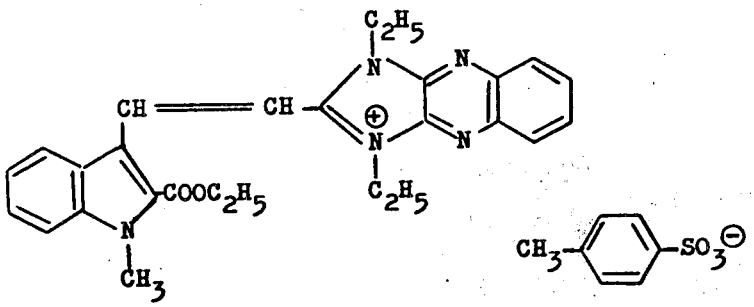
(I - 8)
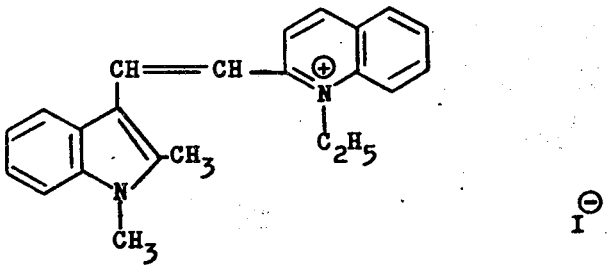
(I - 9)
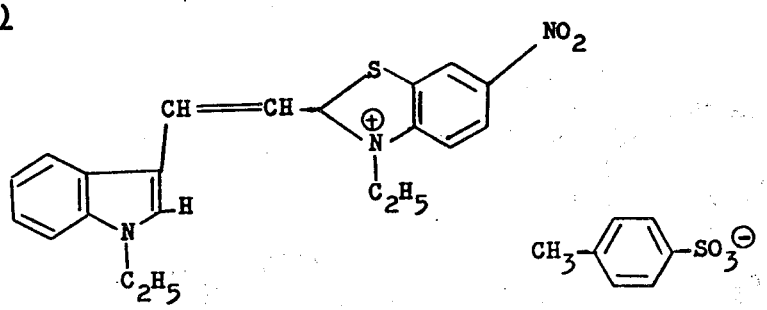

(I - 10)
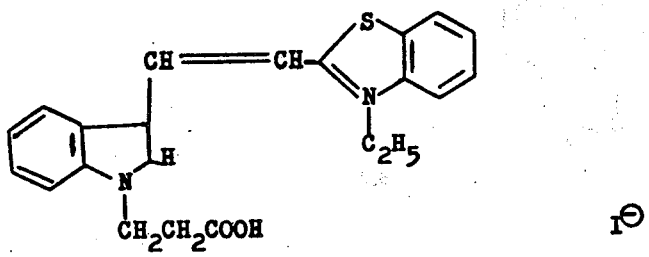
(I - 11)
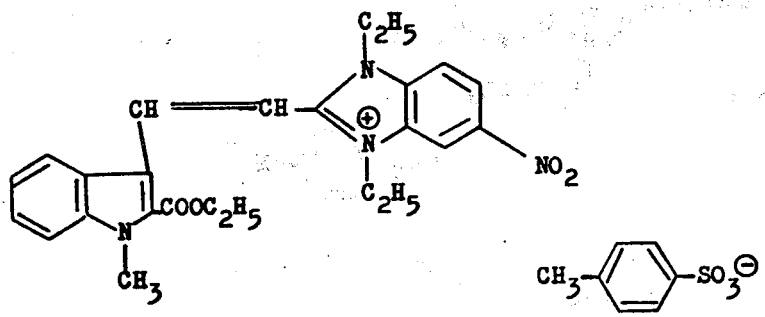
(I - 12)
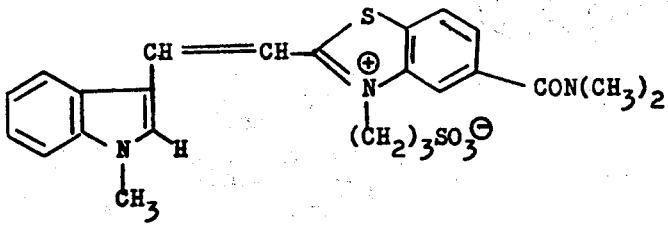
(I - 13)
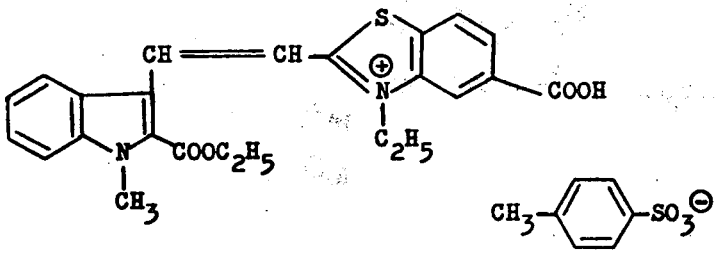
(I - 14)
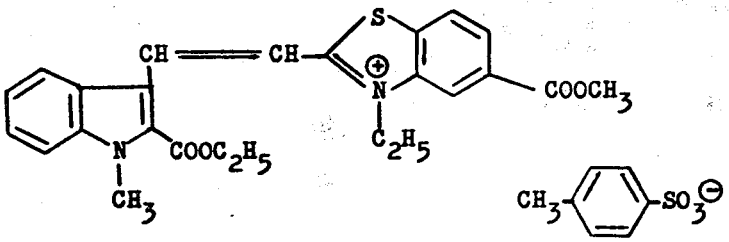

(I - 15)
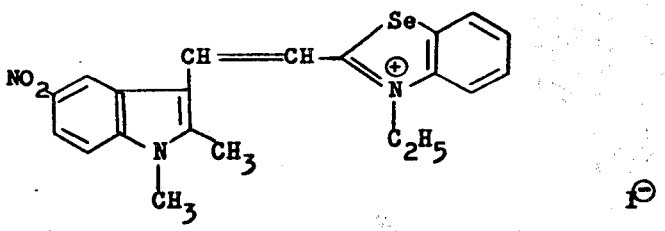
(I - 16)
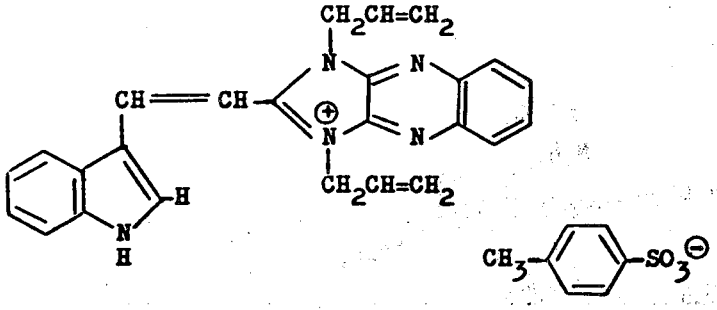
(I - 17)
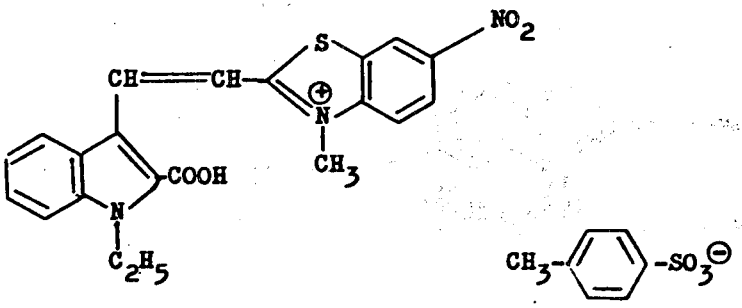
(I - 18)
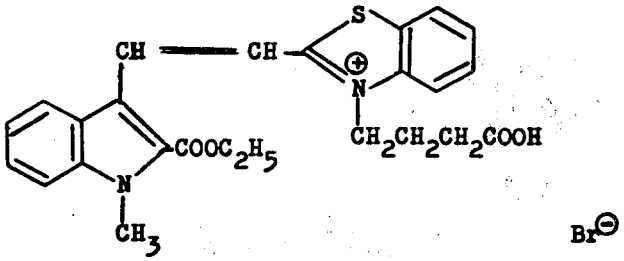
(I - 19)
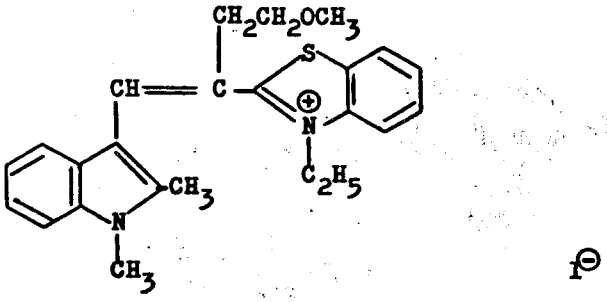

(I - 20)
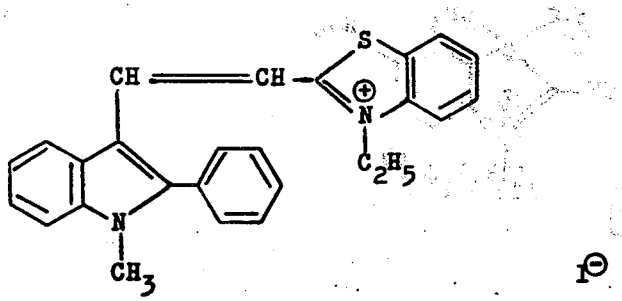
(I - 21)
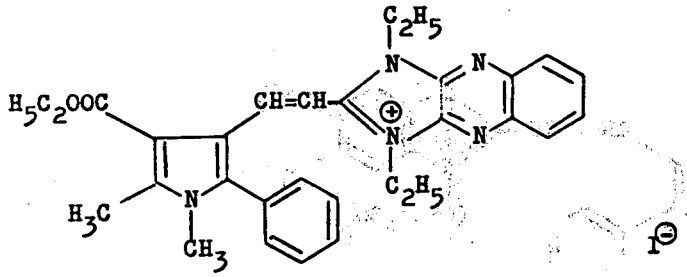
(I - 22)
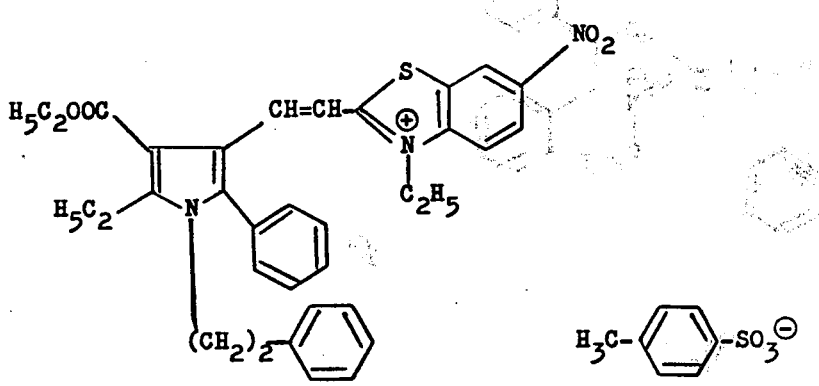
(I - 23)
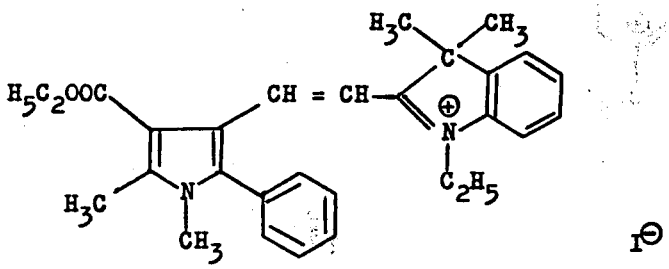

(I - 24)
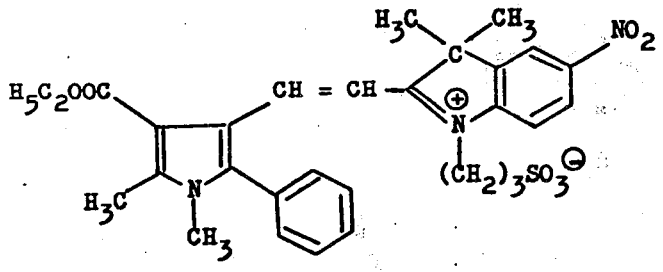
(I - 25)
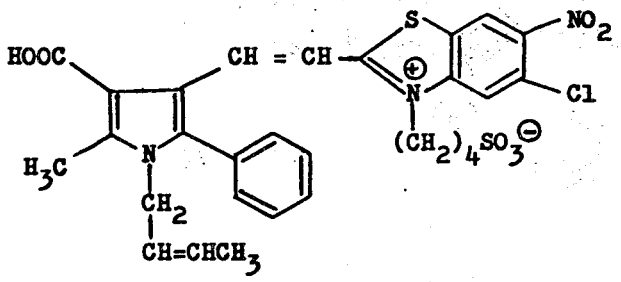
(I - 26)
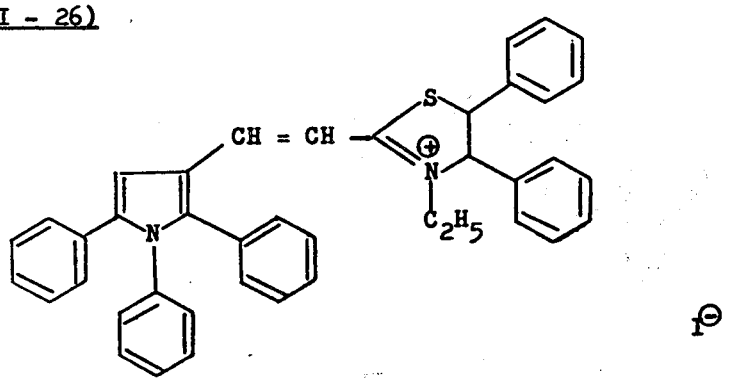
(I - 27)
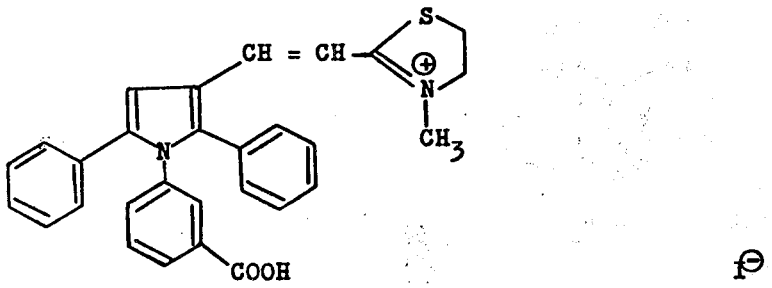

(I - 28)
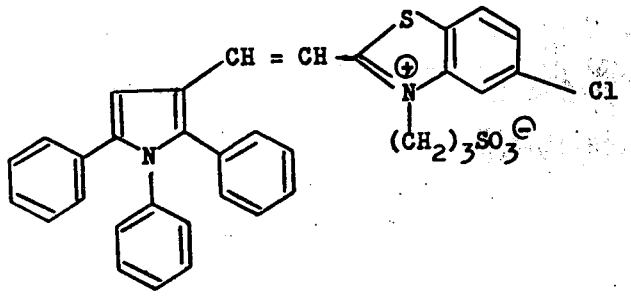
(I - 29)
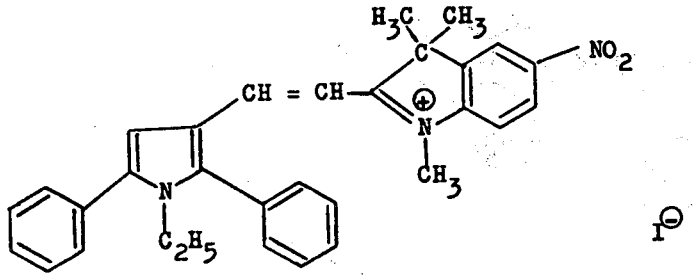
(I - 30)
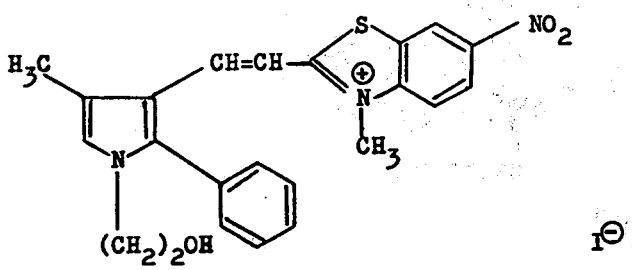
(I - 31)
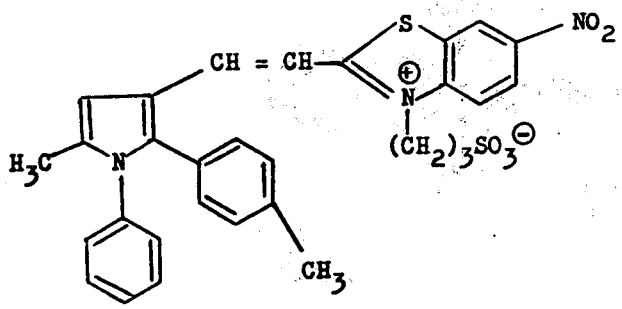

(I - 32)
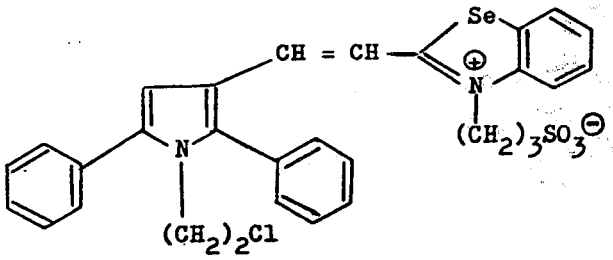
(I - 33)
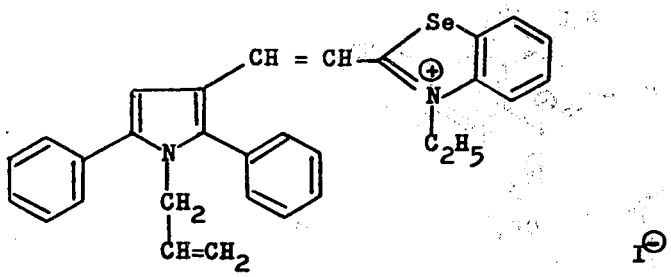
(I - 34)
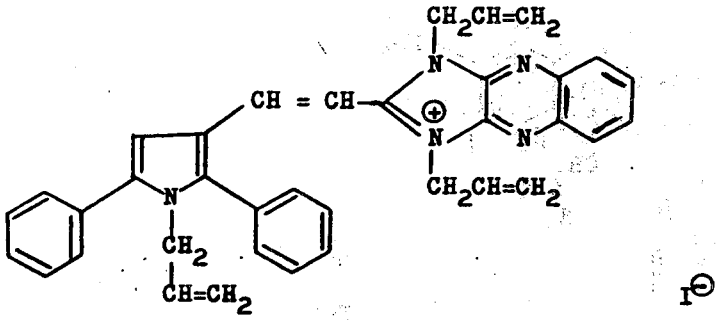
(I - 35)
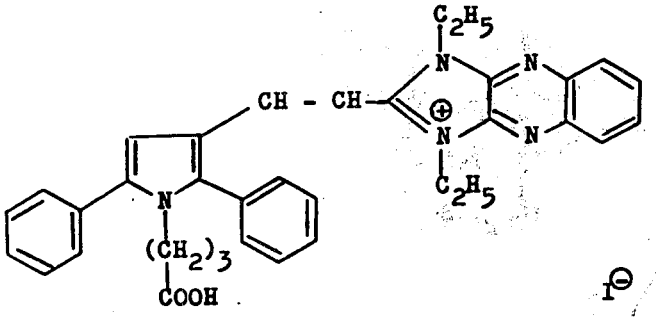

(I - 36)
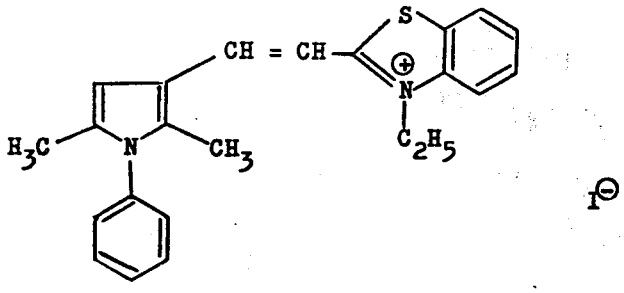
(I - 37)
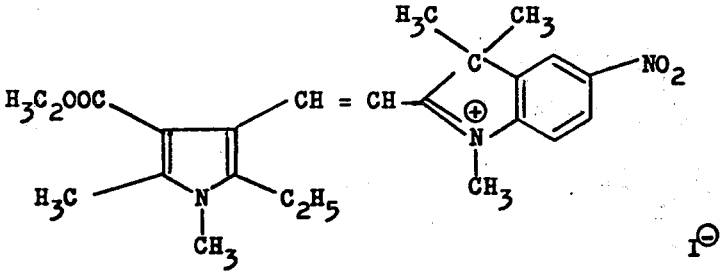
(I - 38)
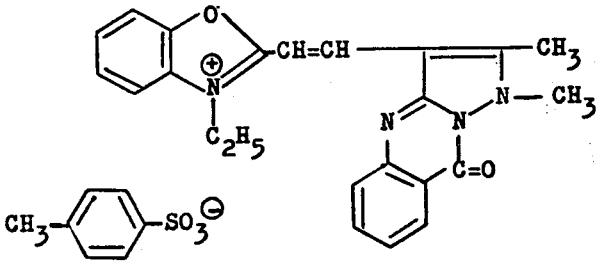
(I - 39)
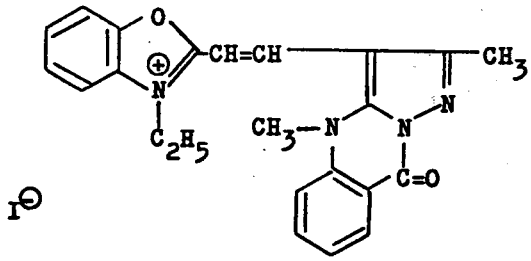

(I - 40)
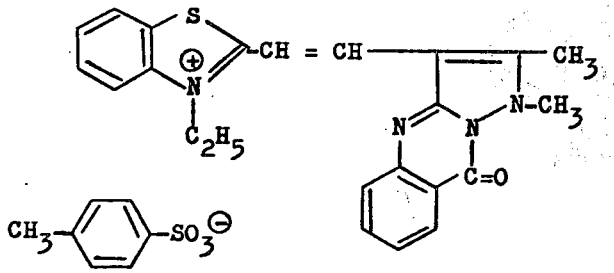
(I - 41)
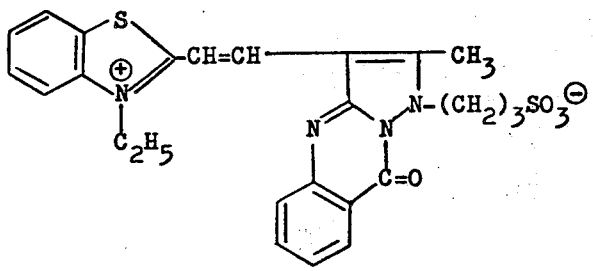
(I - 42)
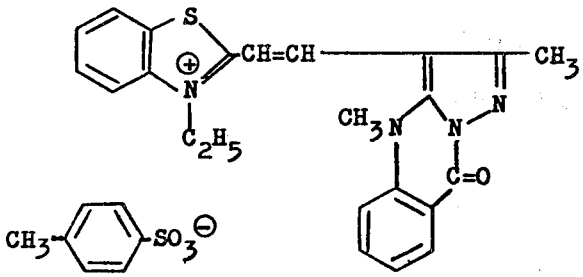
(I - 43)
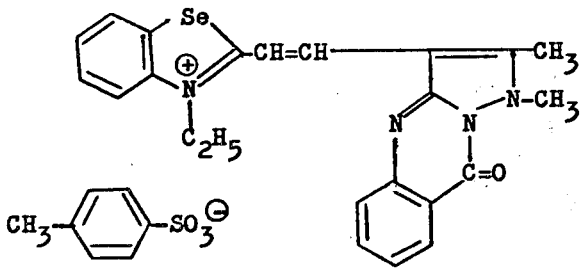

(I - 44)
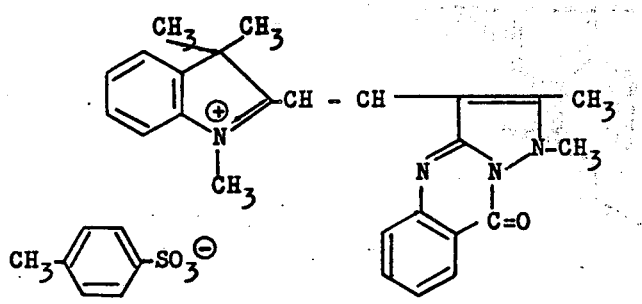
(I - 45)
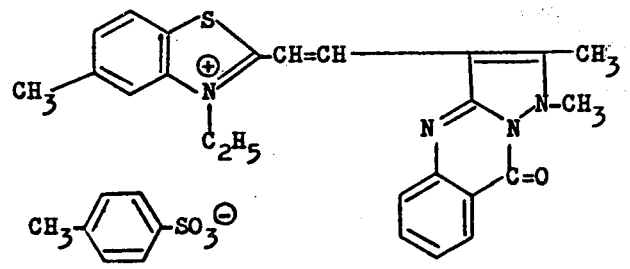
(I - 46)
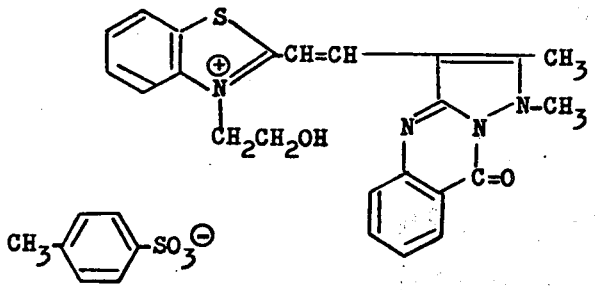
(I - 47)
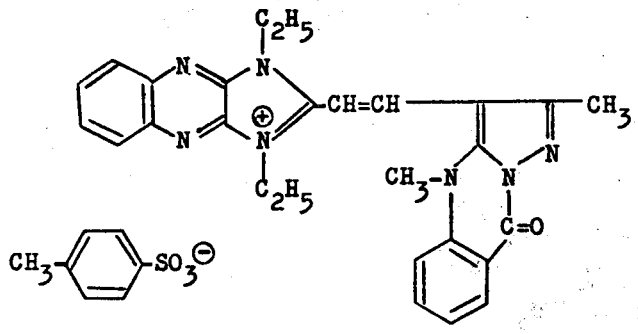

(I - 48)
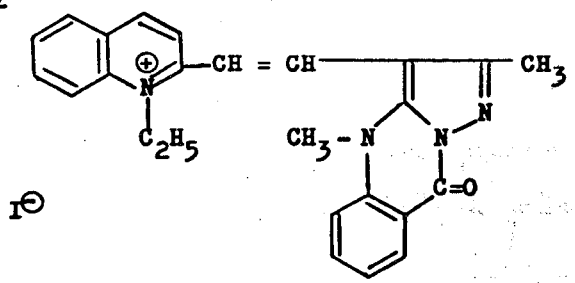
(I - 49)
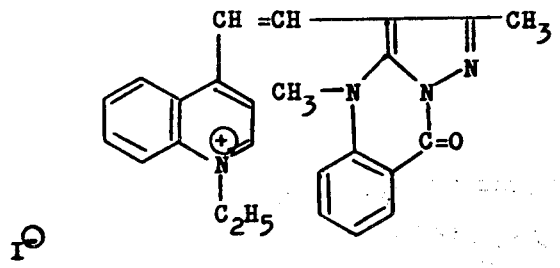
(I - 50)
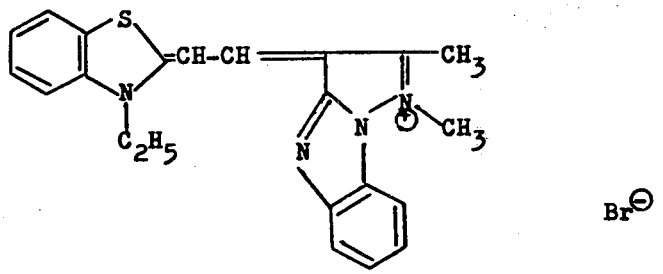
(I - 51)
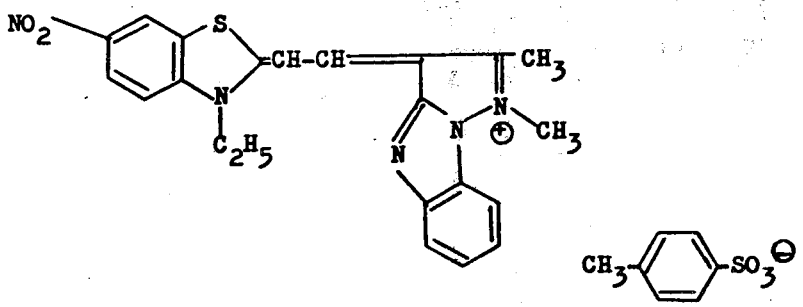
(I - 52)
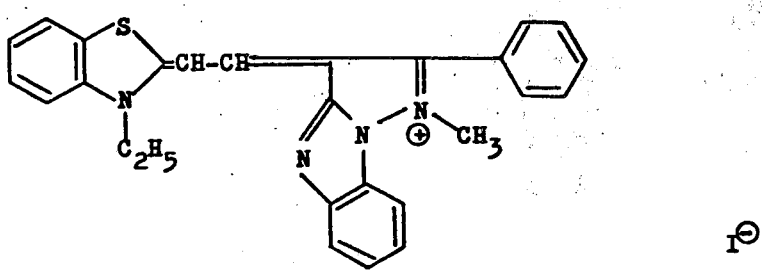

(I - 53)
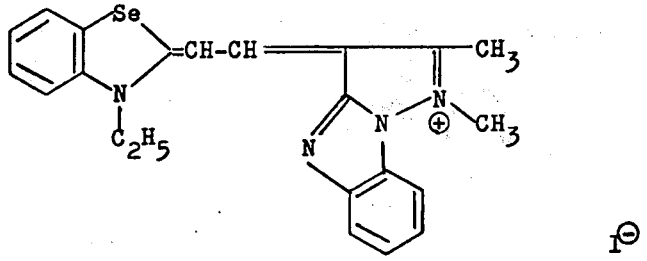
(I - 54)
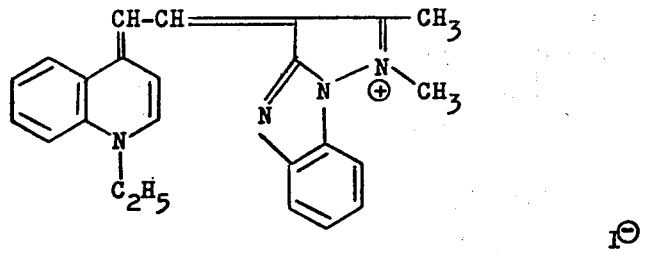
(I - 55)
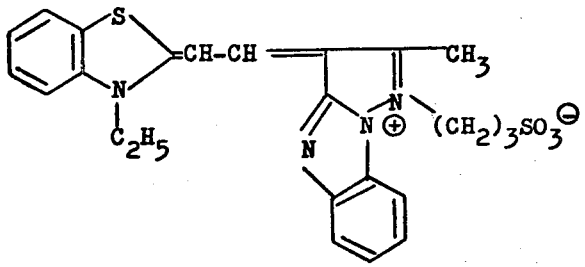
(I - 56)
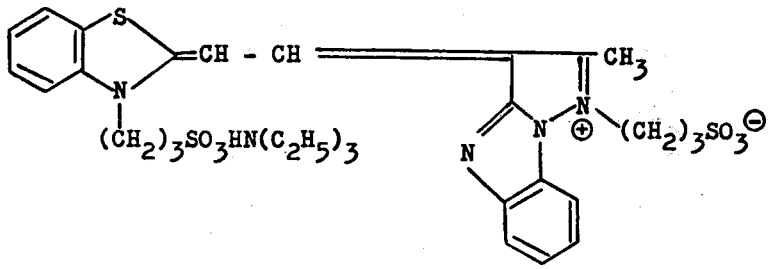
(I - 57)
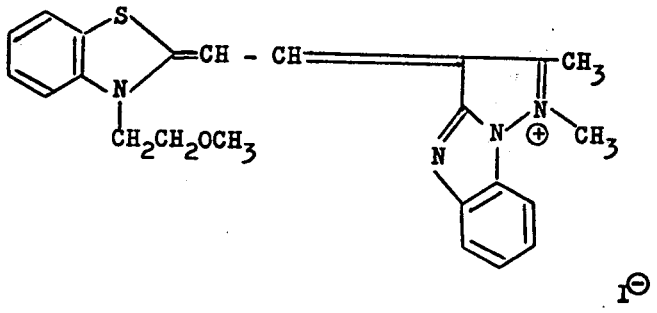

(I - 58)
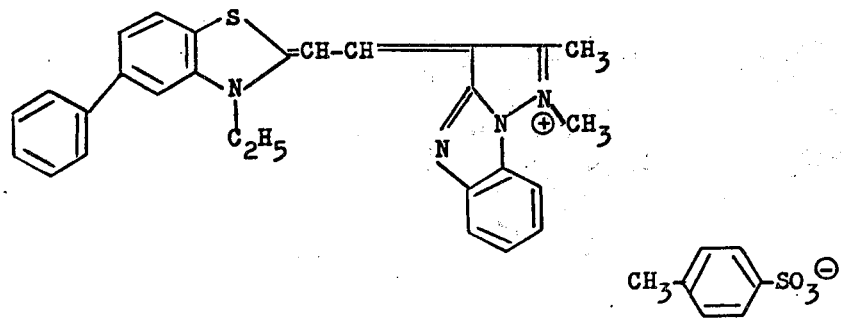
(I - 59)
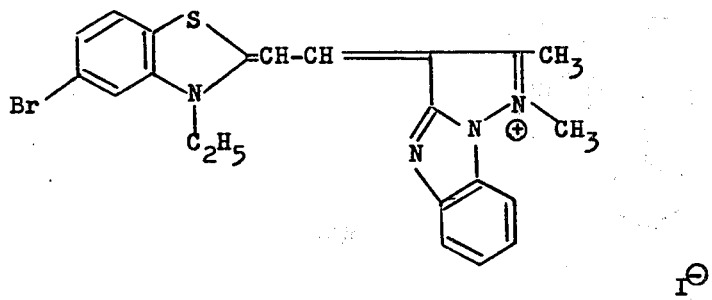
(I - 60)
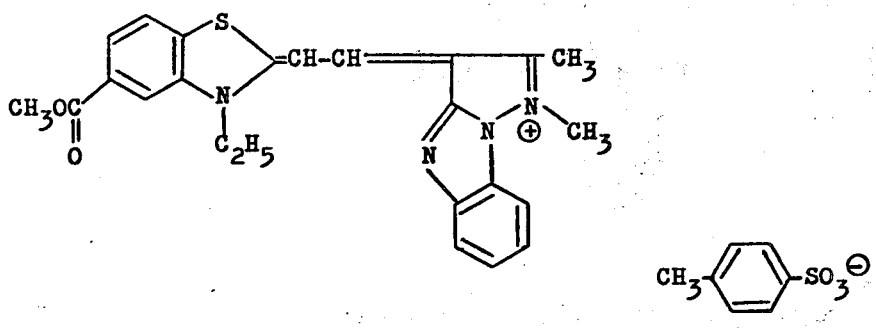
(I - 61)
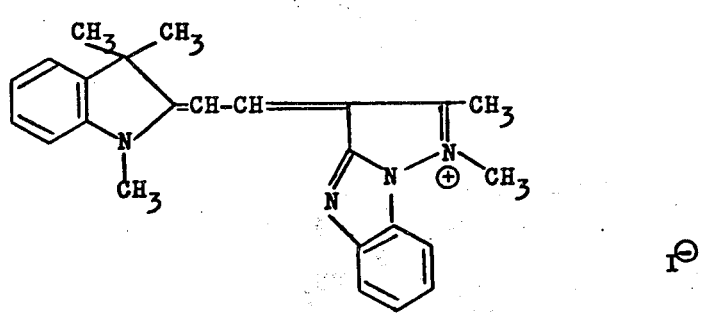

(I - 62)
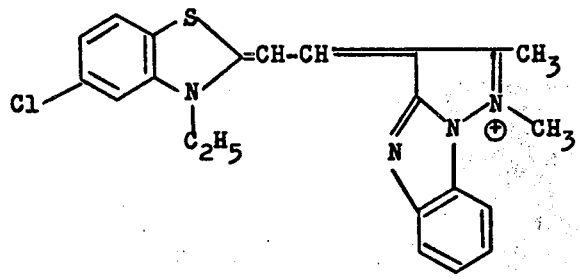
(I - 63)
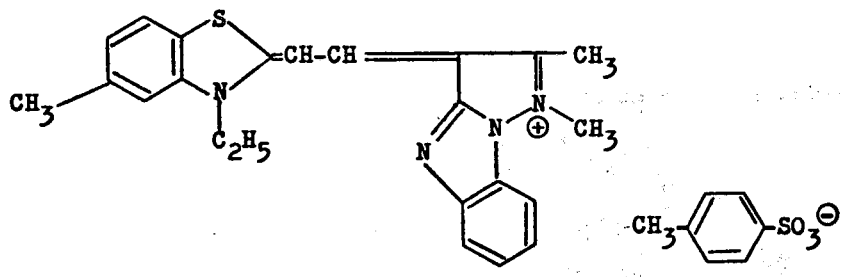
(I - 64)
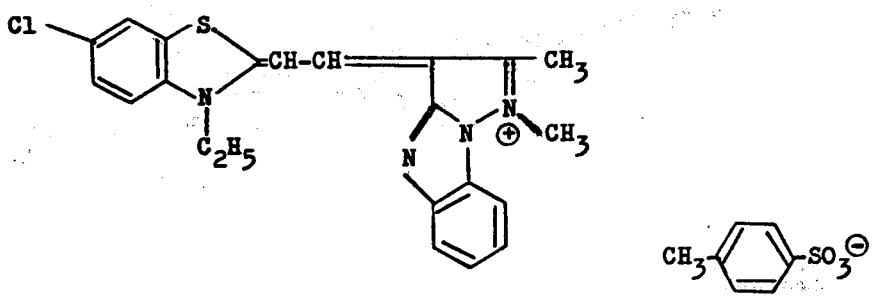
(I - 65)
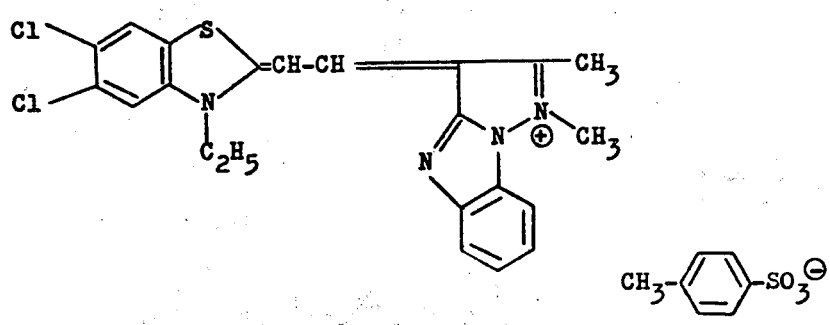

(I - 66)
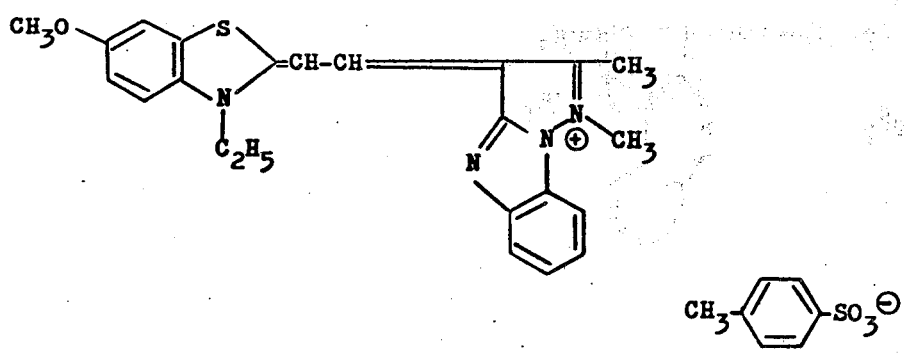
(I - 67)
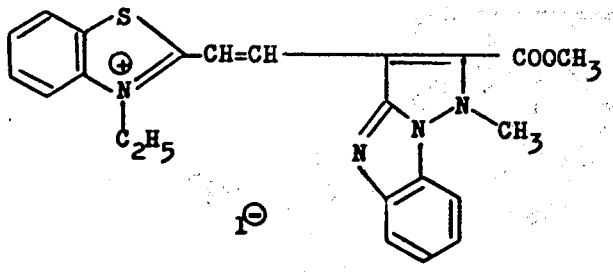
Some examples of compounds represented by the general formula (II) are given below. It should be noted that the compounds suitable for the present invention are not to be limited to these compounds only.
(II - 1)
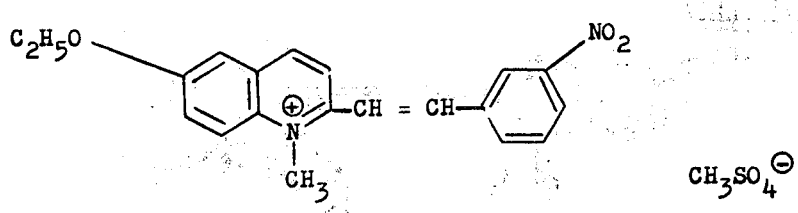
(II - 2)
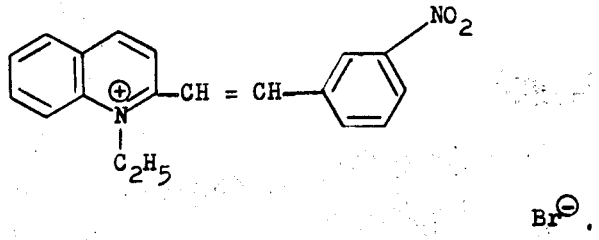
(II - 3)
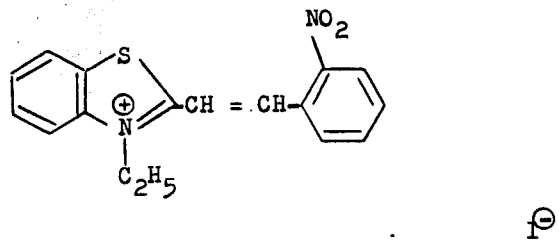

(II - 4)
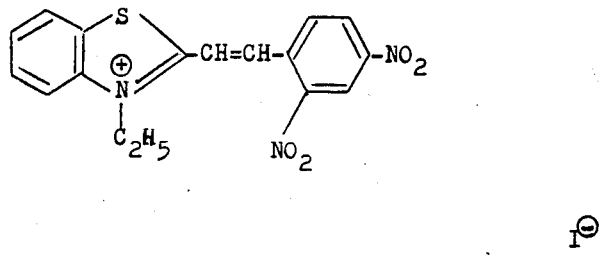
(II - 5)
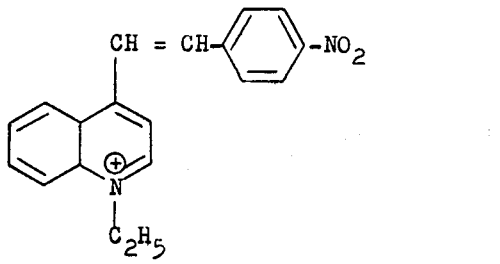
(II - 6)
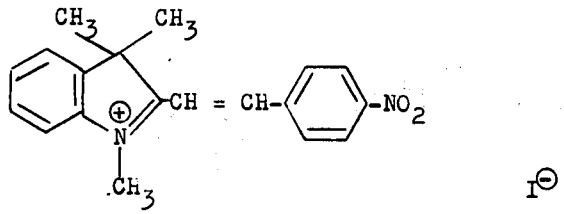
Some compounds represented by the general formulae (III) and (IV) will be illustrated below. However, the compounds applicable to the present invention should not be confined to the following ones.
(III - 1)
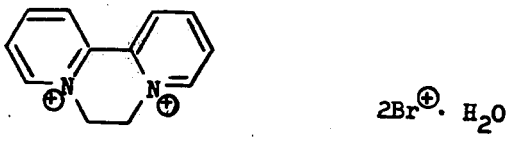
(III - 2)
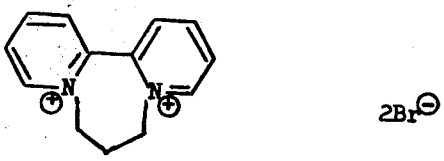

(III - 3)
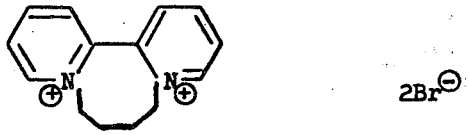
(III - 4)
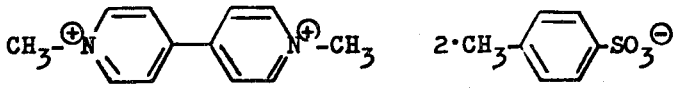
(III - 5)
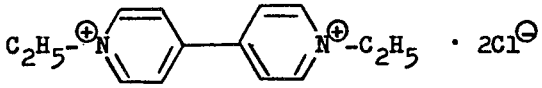
(III - 6)
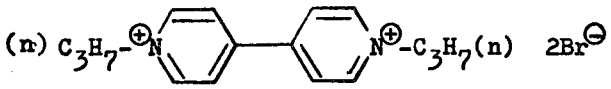
(III - 7)
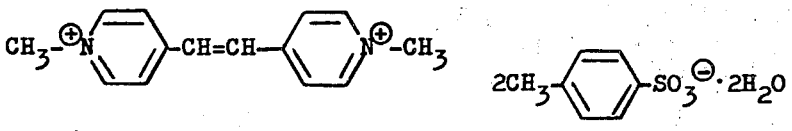
(III - 8)
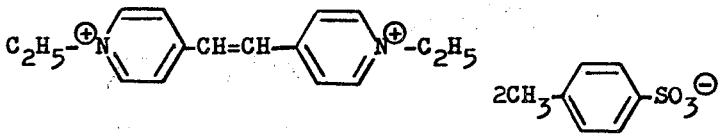
(III - 9)
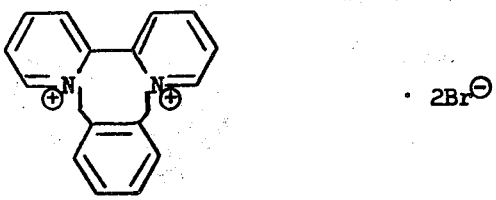

(III - 10)
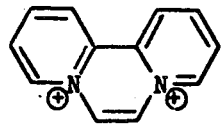
$2Br^{\ominus}$
(III - 11)
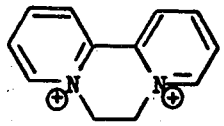
$2NO_3^{\ominus}$
(III - 12)
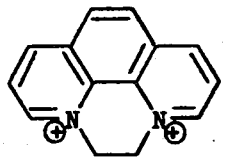
$2Br^{\ominus}$
(III - 13)
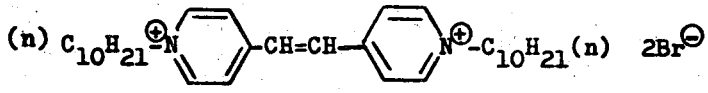
(III - 14)
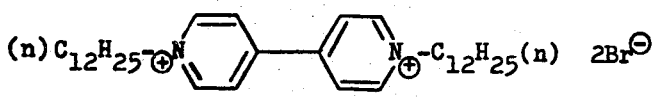
(III - 15)
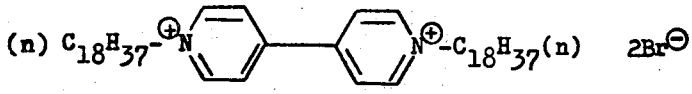

(III - 16)

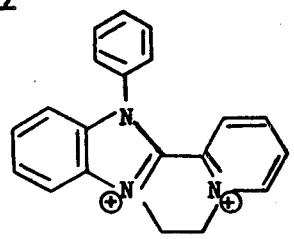

$2Br^{\ominus}$ (III - 17)

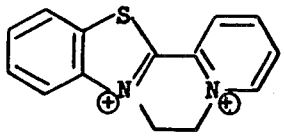

$2Br^{\ominus}$

Most of the above-illustrated compounds are already known and descriptions of the synthetic methods for preparing these compounds, for example, are disclosed in the following literature *Tetrahedron* 24, 2699, 5433 and 6453 (1968); *Journal of Heterocyclic Chemistry* 7, 719 and 401 (1970); ibid., 8, 29 (1971); *Journal of The Chemical Society* (C) 1969 1643; ibid., 1965 5816; German OLS 2,050,819, etc.

Now, some examples of the preparation of the above-described compounds are described in detail in the following.

PREPARATION EXAMPLE 1

(Compound III-9)

Into 50 ml of dimethylformamide were added 7 g of $\alpha$, $\alpha'$-dipyridyl and 25 g of o-xylenebromide. The mixture was refluxed over an oil heating bath for 3 hr. After cooling the mixture, the crystals formed were separated by filtration. Recrystallization of the crystals using ethanol gave 14 g of crystalline needles having a melting point above 350°C. Result of elementary analysis ($C_{18}H_{16}N_2Br_2$)

| | Observed | Calculated |
|---|---|---|
| C = | 51.38% | 51.43% |
| H = | 3.87% | 3.81% |
| N = | 6.95% | 6.67% |

PREPARATION EXAMPLE 2

(Compound III-11)

Compound III-1 (8g) was dissolved in 100 ml water and stirred at room temperature. Into this solution another solution prepared by dissolving $AgNO_3$ (7g) in 100 ml of water was slowly added dropwise. After the completion of the addition, the AgBr formed was removed by filtration. The mother liquor was concentrated under a reduced pressure. The precipitated crystals were purified by recrystallization from ethanol, giving 4 g of colorless needle-shaped crystals having a decomposition point of 215°C.

Result of elementary analysis ($C_{12}H_{12}N_4O_6$)

| | Observed | Calculated |
|---|---|---|
| C = | 46.54% | 46.76% |
| H = | 3.90% | 3.92% |
| N = | 17.90% | 18.18% |

The silver halide emulsions which can be used in the present invention can contain silver chloride, silver bromide, silver chloro-bromide, silver chloro-iodide, or silver chloro-iodobromide.

The basic emulsions used for the direct positive silver halide photographic materials can be divided into two classes.

The first class of basic emulsion contains silver halide crystals within which are distributed free electron trapping centers, and the surface of which is previously fogged by chemical means. This class of emulsion is characterized in that the emulsion itself can form a positive image directly and that the addition of sensitizing dyes can improve the photographic speed not only by spectral sensitization but also by increasing the sensitivity in the intrinsic absorption region. In this class of emulsion, the halogen composition has to be adjusted so that chemical sensitizers or salts of the Group VIII metals, which are used to provide electron trapping centers, can readily be incorporated in the inner portion of the silver halide crystals. In addition, by the addition of organic desensitizers, the background density can be reduced and particularly the re-reversal phenomenon prevented. Further, an increase in the maximum density as well as of the photographic speed and also a reduction of background are realized by the addition of bromide or iodide ion.

The second class of basic emulsion contains silver halide crystals within which no free electron trapping centers exist, and the surface of which is chemically fogged. This type of emulsion contains silver halide crystals which have structural defects at a density as low as possible, and which desirably consist of pure silver bromide with regular structure free of twin surfaces.

This type of emulsion, although the emulsion itself does not provide such, is converted so as to give direct positive images by the use of organic desensitizers.

Examples of basic emulsions containing electron trapping centers are disclosed in, for example, Japanese Patent Publication Nos. 4125/1968 and 29405/1968, U.S. Pat. Nos. 2,401,051, 2,717,833, 2,976,149, 3,023,102, 3,445,235, 3,537,858, 3,531,288, 3,615,610, 3,574,625, 3,547,647, 3,428,455, British Pat. Nos. 707,704, and 690,997, and British Patent Application No. 16507/66.

Examples of patents describing sensitive materials containing basic emulsions without electron trapping centers are the following;

U.S. Pat. Nos. 3,501,306; 3,501,307; 3,501,310; 3,531,288; 3,586,672; 3,501,311; 3,501,309; 3,579,345 and 3,492,123, French Pat. Nos. 1,522,344 and 1,520,824.

Of the two classes of basic emulsions, both can be used to practice the present invention. Particularly those without electron trapping centers are advantageously used.

The silver halide photographic emulsions used in the present invention are previously fogged optically or chemically. Fogging centers of a chemical nature can be formed by the incorporation of organic reducing compounds including hydrazine derivatives, formaldehyde, dioxothiourea, polyamine compounds, aminoboranes, methyldichlorosilane, etc.

Further, the combined use of reducing agents with metal ions more noble than silver ion or with halide ions is also suitable. Examples of patents describing such techniques are as follows:

U.S. Pat. Nos. 2,497,875; 2,588,982; 3,023,102; 3,367,778; 3,445,235; 3,501,310; 3,501,305; 3,477,852; 3,501,307 and 3,531,288, British Pat. Nos. 707,704; 723,019 and 821,251, French Pat. Nos. 1,520,822 and 1,520,824, Belgian Pat. No. 708,563 and Japanese Pat. No. 13488/1968.

In the emulsions used to practice the present invention, it is advantageous to use as a protective colloid gelatin and particularly an inert gelatin. Instead of gelatin other materials can also be used including photographically inert gelatin derivatives (for example, phthalated gelatin), water soluble synthetic polymers such as polyvinyl acrylate, polyvinyl alcohol, polyvinylpyrrolidone, or salts of polyvinyl alginate.

The silver halide photographic emulsions for use in practicing the present invention can further contain; as a stabilizer for the fogging centers mercapto compounds, thione compounds, or tetrazaindene compounds; as an background improving agent stilbene or triazine compounds; a whiteness improving agent; a UV absorber; as a hardening agent chrome alum, 2,4-dichloro-S-triazine compound, aziridine compounds, epoxide compounds, mucochloric acid compounds, halo-formyl-maleic acid compounds; as coating aids sodium (polyoxyalkylene sulfonate), saponin, anionic surface active agents having betaine structure; antispectics plasticizers; or vinyl compounds such as polyalkylacrylates, copolymers of alkylacrylates and acrylic acid, or polyalkyleneoxide compounds. Still further they may contain color couplers.

As for the particle size of silver halide crystal included in the photographic emulsions for use in the present invention, no special limitations are imposed within the range for ordinary use. A particularly preferable range lies between 0.05 and 1.0 micron.

The silver halide crystals used can be of a regular or irregular shape, however, those of a regular shape are preferred because better results are obtained in the present invention. Further, monodispersed emulsions are suited for the present invention, though those other than monodispersed emulsions can also be employed.

The amounts or concentrations of the compounds represented by the general formulae (I), (II), (III) and (IV) used in the emulsion can vary according to the amount and the surface area of the silver halide and also the end use purpose of the resulting product. The dimethine dyes represented by the formula (I) are especially effective when used at about $1 \times 10^{-6}$ to $2 \times 10^{-2}$ mol per 1 mol of silver halide. For the compounds represented by the formulae (II), (III) and (IV) particularly effectve range of concentration is from about $1 \times 10^{-5}$ to $1 \times 10^{-1}$ mol per 1 mol of silver halide. The compounds represented by the formulae (I), (II), (III) and (IV) can be advantageously used as solutions in water or in water-miscible solvents such as methanol, ethanol, methyl cellosolve, methyl ethyl ketone, acetone, pyridine, etc. Ultra-sonic vibration can be employed to dissolve these dyes. Other procedures employed in the spectral sensitization of negative photographic emulsions can also be used. Some of these procedures are described in the following patents:

Japanese Pat. Nos. 8231/1970; 23389/1969; 27555/1969 and 22948/1969, U.S. Pat. Nos. 3,485,634; 3,342,605; 2,912,343 and 3,649,286.

The addition of dyes into the emulsion can most conveniently be carried out immediately before the coating, though, of course, addition is possible during the chemical ripening or the silver halide precipitation in the emulsion preparation.

The direct positive silver halide photographic emulsions prepared in accordance with the present invention, coated on various supports which have been conventionally employed in photographic materials, can be used not only as high-contrast materials including those used to duplicate lithographic images or duplicate industrial drawings, but as relatively low contrast images such as those to duplicate microphotographic images. They can also be used for color photography. Further, the direct positive silver halide emulsions of the present invention are useful in photographic applications based on, in addition to those based on visible light irradiation, electron beam, X-ray and $\gamma$-ray radiations.

The important features of the present invention are shown in the following.

It has already been described that the dimethine dyes represented by the general formula (I) are suited for the sensitization of direct positive emulsions. In addition, it has also been mentioned that the combined use of the dyes represented by the general formula (I) and nitrostyril dyes brings about a sensitivity increase, a reduction of minimum density, and an improvement of storage stability.

Our extensive research have disclosed that the degree of the speed increase and the minimum density reduction is larger when a dimethine dye represented by the formula (I), a compound represented by the formula (II) and moreover a compound represented either by the formula (III) or (IV) are simultaneously used than in the case of the combined use of a dye represented by (I) and a compound of the formula (II). Further, the combination of the three ingredients brings about a higher maximum density than in either the case of the sole use of a dye represented by the formula (I), or of the combined use of a dye represented by the formula (I) and a compound of the formula (II).

Still further, by a suitable selection of the dimethine dyes represented by the general formula (I), one can prepare a direct positive silver halide photographic emulsion with a minimized residual color.

As for the stability of the properties of the material during storage, the photographic materials utilizing positive emulsions containing the three components of the invention can be characterized as having a quite small change of the maximum density as well as the photographic speed.

The present invention will now be described in greater detail by reference to the following examples. Unless otherwise indicated, all parts, percents, ratios and the like are by weight.

EXAMPLE

An emulsion comprising silver chlorobromide (AgBr 20 mol%, AgCl 80 mol%), the pH of which was controlled to 10, was fogged by the use of hydrazine together with an auric chloride salt. To this original emulsion additives were introduced according to the formulations listed in Tables 1 and 2, and each resulting mixture was coated on a cellulose triacetate film in a dry thickness of 5 $\mu$.

Each coated sample was irradiated through an optical wedge with light from an incandescent lamp of a color temperature of 2845°K, and processed using a developer having the following formulation at 20°C for 3 minutes and then by a fixer.

| Developer Composition | |
|---|---|
| Water (at about 30°C) | 50 ml |
| Sodium Sulfite (anhydrous) | 30 g |
| Paraformaldehyde | 7.5 g |
| Sodium Bisulfite | 2.2 g |
| Boric Acid | 7.5 g |
| Hydroquinone | 22.5 g |
| Potassium Bromide | 1.6 g |
| Water to make | 1000 ml |

Each film strip thus obtained was subjected to density measurement using a P-type Densitometer produced by the Fuji Photo Film Co., Ltd. to give a characteristic curve. The results of the sensitometry are shown in Table 1 and 2.

Table 1

| | No. | Compounds Added (mg/1 mol Ag) | | Relative[1] Speed in the Reversal Mode | $D_{max}$ | $D_{min}$ |
|---|---|---|---|---|---|---|
| 1 | I-1 (400) | | | NI[2] | 3.6 | NI |
| 2 | | II-1 (1400) | | 10 | 3.6 | 0.60 |
| 3 | | | III-1 (1400) | NI | 3.7 | NI |
| 4 | I-1 (200) | II-1 (700) | | 10.5 | 3.7 | 0.60 |
| 5 | I-1 (400) | II-1 (1400) | | 10 | 3.6 | 0.55 |
| 6 | I-1 (200) | | III-1 (700) | NI | 3.7 | NI |
| 7 | I-1 (400) | | III-1 (1400) | NI | 3.7 | NI |
| 8 | I-1 (200) | II-1 (700) | III-1 (700) | 1320 | 3.8 | 0.15 |
| 9 | I-1 (400) | II-1 (700) | III-1 (700) | 1520 | 3.8 | 0.10 |

[1]The values represent the photographic speeds upon irradiation through a yellow filter (Fuji Filter Sc-48 produced by the Fuji Photo Film Co., Ltd.).

[2]NI means that no reversal image was obtained.

Table 2

| | No. | Compounds Added (mg/mol of Ag) | | Relative Speed in the Reversal Mode | $D_{max}$ | $D_{min}$ |
|---|---|---|---|---|---|---|
| 10 | I-38 (400) | | | NI | 3.7 | NI |
| 11 | | II-2 (1400) | | 8.5 | 3.7 | 0.72 |
| 12 | | | III-4 (1400) | NI | 3.7 | NI |
| 13 | I-38 (200) | II-2 (700) | | 9.5 | 3.7 | 0.60 |
| 14 | I-38 (400) | II-2 (1400) | | 9.5 | 3.7 | 0.53 |
| 15 | I-38 (200) | | III-4 (700) | NI | 3.7 | NI |
| 16 | I-38 (400) | | III-4 (1400) | NI | 3.7 | NI |
| 17 | I-38 (200) | II-2 (700) | III-4 (700) | 1030 | 3.8 | 0.17 |
| 18 | I-38 (400) | II-2 (700) | III-4 (700) | 1050 | 3.8 | 0.15 |
| 19 | I-50 (400) | | | NI | 3.6 | NI |
| 20 | | II-1 (1400) | | 10.5 | 3.6 | 0.56 |
| 21 | | | III-12 (1400) | NI | 3.6 | NI |
| 22 | I-50 (200) | II-1 (700) | | 11.0 | 3.6 | 0.40 |
| 23 | I-50 (400) | II-1 (1400) | | 11.5 | 3.6 | 0.36 |
| 24 | I-50 (200) | | III-12 (700) | NI | 3.5 | NI |
| 25 | I-50 (400) | | III-12 (1400) | NI | 3.5 | NI |
| 26 | I-50 (200) | II-1 (700) | III-12 (700) | 1410 | 3.8 | 0.10 |
| 27 | I-50 (400) | II-1 (700) | III-12 (700) | 1450 | 3.8 | 0.07 |

From the results in these tables, it is evident that the direct positive silver halide emulsions containing the three components in accordance with the present invention are superior in photographic speed, maximum and minimum densities.

While the invention has been described in detail and with reference to specific embodiments thereof, it will be apparent to one skilled in the art that various changes and modifications can be made therein without departing from the spirit and scope thereof.

What is claimed is:

1. A fogged direct positive silver halide photographic emulsion containing

1. at least one dimethine dye having the general formula (I):

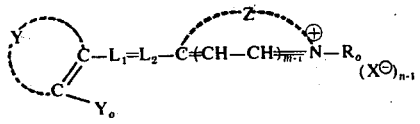

(I)

wherein Y represents a non-metallic atom group necessary to complete a heterocyclic nucleus selected from the group consisting of a pyrole nucleus, an indole nucleus, a pyrazolo quinazolone nucleus, or a pyrazolo benzimidazole nucleus; $Y_o$ represents a hydrogen atom, an alkyl group, an aryl group, a carboxyl group, an alkoxy group, an alkoxycarbonyl group, a hydroxyl group, or halogen atom Z represents a nonmetallic atom group necessary to complete a 5- or 6-membered heterocyclic ring; $L_1$ and $L_2$ represents a methine group, and $R_o$ represents an alkyl group or an aryl group; m and n represents 1 to 2, and X represents an anion;

2. at least one compound having the general formula (II):

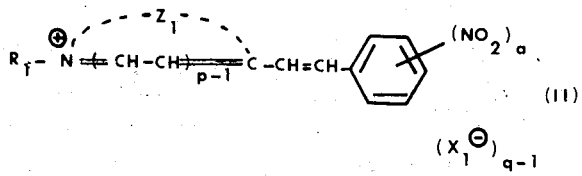

(II)

wherein $Z_1$ represents the non-metallic atoms necessary to complete a 5- or 6-membered heterocyclic ring; $R_1$ represents an alkyl group, and $X_1$ represents an anion; and a, p, and q each represents 1 or 2; and

3. at least one compound having the general formula (III):

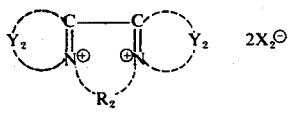

(III)

or the general formula (IV):

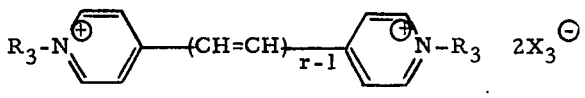

(IV)

wherein $Y_1$ and $Y_2$, which can be the same or different each represents the non-metallic atoms necessary to complete a pyridine, benzothiazole or benzimidazole nucleus; or $Y_1$ and $Y_2$ may combine together to complete a 1,10-phenenthroline ring;

$R_2$ represents $-(CH_2)_{m}-$, in which $m_1$ is an integer of from 2 to 4), —CH=CH—, or

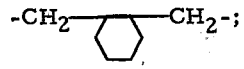

$R_3$ represents an alkyl group, *r* represents 1 or 2, and $X_2$ and $X_3$ each represents an anion.

2. The direct positive silver halide photographic emulsion of claim 1, wherein said heterocyclic ring formed by Z and $Z_1$ is a thiazole ring, a benzothiazole ring, a naphthothiazole ring, an oxazole ring, a benzoxazole ring, a naphthoxazole ring, and indolenine ring, a benzoselenazole ring, a naphthoselenazole ring, a quinoline ring, a thiazoline ring, a pyridine ring, an imidazole ring, a benzimidazole ring, or an imidazo [4,5-b] quinoxaline ring; wherein $L_1$ and $L_2$ each represents —CH= or $-CR_4=$ in which $R_4$ is an alkyl group or an aryl group; wherein said alkyl group for $R_o$ is an unsubstituted alkyl group or a substituted alkyl group, said substituted alkyl group being a hydroxyalkyl group, a acetoxyalkyl group, an alkoxycarbonylalkyl group, a sulfoalkyl group, an arylalkyl group, or a vinylmethyl group; wherein said alkyl group for $R_1$ and $R_3$ is an unsubstituted alkyl group or a substituted alkyl group, said substituted alkyl group being a hydroxyalkyl group, a acyloxyalkyl group, a carboxyalkyl group, an alkoxyalkyl group, a sulfoalkyl group, an unsubstituted aralkyl group, a substituted aralkyl group, said substituted aralkyl group being a sulfoaralkyl group or a carboxyaralkyl group, or a vinylmethyl group.

3. The direct positive silver halide photographic emulsion of claim 1, wherein said dimethine dye represented by the general formula (I) has the general (V)

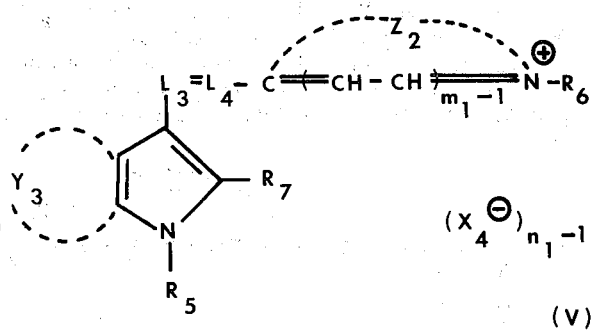

(V)

wherein $R_7$ represents a hydrogen atom, a lower alkyl group, a halogen atom, a carboxyl group, a lower alkoxycarbonyl group or an aryl group; $Y_3$ represents the non-metallic atoms necessary to complete a condensed benzene ring; $Z_2$ has the same meaning as Z, $L_3$ and $L_4$ each has the same meaning as $L_1$ and $L_2$, respectively; $R_5$ represents a hydrogen atom, an alkyl group, or an aryl group; $R_6$ has the same meaning as $R_o$; $m_1$ has the same meaning as m; and $n_1$ has the same meaning as *n*.

4. The direct positive silver halide emulsion of claim 1, wherein said dimethine dye represented by the general formula (I) has the following general formula (VI)

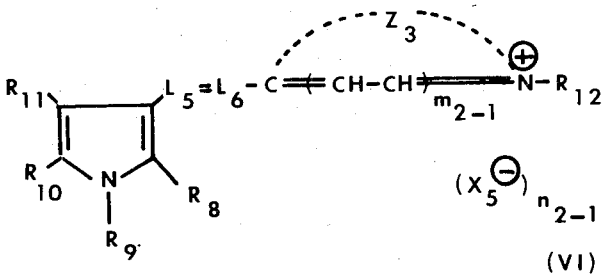

(VI)

wherein $R_8$ represents an alkyl group or an aryl group; $R_{10}$ represents a hydrogen atom, an alkyl group or an aryl group; $R_{11}$ represents a hydrogen atom, an alkyl group, a carboxyl group or an alkoxycarbonyl group; $R_9$ and $R_{12}$ each have the same meaning as $R_o$, $Z_3$ has the same meaning as Z, $m_2$, $n_2$, $X_5$, $L_5$ and $L_6$ each has the same meaning as m, n, X, $L_1$ and $L_2$ respectively.

5. The direct positive silver halide emulsion of claim 1, wherein said dimethine dye represented by the general formula (I) has the general formula (VII)

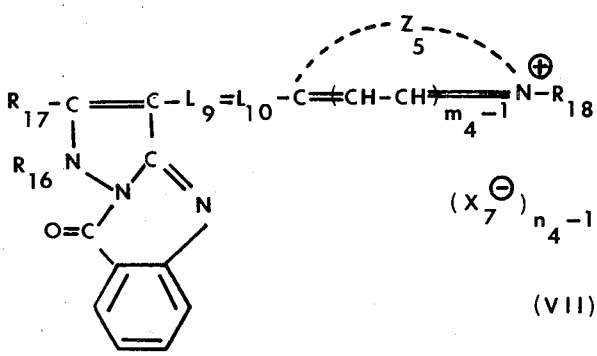

(VII)

wherein $R_{17}$ represents a hydrogen atom, an alkyl group, an aryl group, a carboxyl group, an alkoxycarbonyl group, an alkoxy group, a benzyl group or a hydroxyl group; $R_{16}$ represents an alkyl group; $R_{18}$ has the same meaning as $R_o$; $L_9$ and $L_{10}$ each has the same meaning as $L_1$ and $L_2$; and $Z_5$, $m_4$, $n_4$ and $X_7$ each have the same meaning as Z, $m$, $n$ and X, respectively.

6. The direct positive silver halide emulsion of claim 1, wherein said dimethine dye represented by the general formula (I) has the following general formula (VIII)

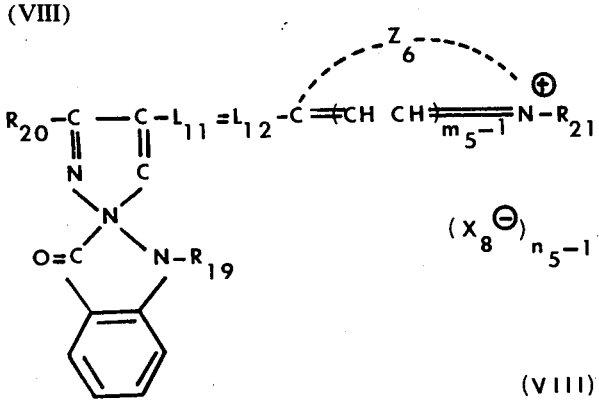

(VIII)

wherein $R_{20}$ represents a hydrogen atom, an alkyl group, an aryl group, a carboxyl group, an alkoxycarbonyl group, an alkoxy group, a benzyl group or a hydroxyl group; $R_{21}$ has the same meaning as $R_o$; $L_{11}$ and $L_{12}$ each have the same meaning as $L_1$ and $L_2$; $R_{19}$ represents a hydrogen atom, an alkyl group, a cycloalkyl group, or an aryl group, $Z_6$, $m_5$, $n_5$ and $X_8$ each has the same meaning as Z, $m$, $n$ and X, respectively.

7. The direct positive silver halide emulsion of claim 1, wherein said dimethine dye represented by the general formula (I) has the following general formula (IX)

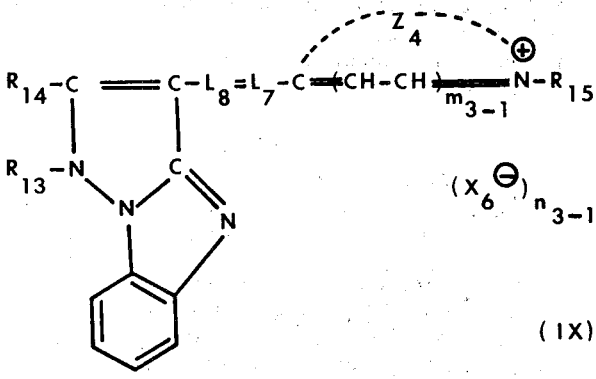

(IX)

wherein $R_{13}$ represents an alkyl group; $R_{14}$ represents a hydrogen atom, an alkyl group, a carboxyl group, an alkoxycarbonyl group, or an aryl group; $R_{15}$ has the same meaning as $R_o$; $Z_4$, $m_3$, $n_3$ and $X_5$ each has the same meaning as Z, $m$, $n$ and X, respectively.

8. The direct positive silver halide photographic emulsion of claim 1, wherein said silver halide in said direct positive silver halide emulsion is chemically fogged.

9. The direct positive silver halide photographic emulsion of claim 8, wherein said silver halide is fogged with the combination of a reducing agent and an auric compound.

10. The direct positive silver halide photographic emulsion of claim 1, wherein said emulsion includes a photographic color coupler.

11. The direct positive silver halide photographic emulsion of claim 1, wherein said silver halide emulsion contains chemically fogged silver halide crystals having free electron trapping centers therein.

12. The direct positive silver halide photographic emulsion of claim 1, wherein said silver halide emulsion contains chemically fogged silver halide crystals containing no free electron trapping centers therein.

13. The direct positive silver halide photographic emulsion of claim 1, wherein said compound of the general formulae (I) to (IV) ranges from $1 \times 10^{-6}$ to $2 \times 10^{-2}$ moles per 1 mol of silver halide.

14. A direct positive silver halide photographic material comprising a support having thereon a layer of a direct positive silver halide photographic emulsion layer of Claim 1.

* * * * *